US011359826B2

(12) United States Patent
Yang et al.

(10) Patent No.: US 11,359,826 B2
(45) Date of Patent: Jun. 14, 2022

(54) HUMIDIFIER WITH FLOW CONTROL ARRANGEMENT

(71) Applicant: Shenzhen Chenbei Technology Co., Ltd., Shenzhen (CN)

(72) Inventors: Lin Yang, Shenzhen (CN); Hai Yang, Shenzhen (CN)

( * ) Notice: Subject to any disclaimer, the term of this patent is extended or adjusted under 35 U.S.C. 154(b) by 86 days.

(21) Appl. No.: 16/901,958

(22) Filed: Jun. 15, 2020

(65) Prior Publication Data

US 2020/0393149 A1 Dec. 17, 2020

(30) Foreign Application Priority Data

Jun. 14, 2019 (CN) ..... 201910517829.1

(51) Int. Cl.
*F24F 6/00* (2006.01)

(52) U.S. Cl.
CPC ..... *F24F 6/00* (2013.01); *F24F 2006/008* (2013.01)

(58) Field of Classification Search
CPC ..... F24F 2006/008; F24F 6/14; F24F 6/12; F24F 13/00; F24F 6/00; Y02B 30/54
See application file for complete search history.

(56) References Cited

U.S. PATENT DOCUMENTS 9,360,227 B2 * 6/2016 Barker ..... F24F 6/00
10,563,873 B2 * 2/2020 Lai ..... B01F 23/20
10,962,244 B2 * 3/2021 Cai ..... F24F 6/12
2012/0222548 A1 * 9/2012 Lev ..... F24F 6/12 261/119.1
2014/0326802 A1 * 11/2014 Ljuhar ..... B05B 17/0615 239/102.2
2016/0146490 A1 * 5/2016 McDonnell ..... F24F 6/12 261/70
2016/0305674 A1 * 10/2016 Kim ..... F24F 6/02
2019/0041084 A1 * 2/2019 Atkins, Jr. ..... F24F 6/14
2019/0049133 A1 * 2/2019 Cai ..... A61L 9/20
2019/0072289 A1 * 3/2019 Lai ..... B01F 3/04
2019/0293309 A1 * 9/2019 Cai ..... F24F 6/12

* cited by examiner

*Primary Examiner* — Stephen Hobson
(74) *Attorney, Agent, or Firm* — Tsz Lung Yeung

(57) ABSTRACT

A humidifier includes a base, a water storage tank, an atomizer, and a flow control arrangement. The flow control arrangement includes a water buffering housing, a water control tank a water regulating assembly and a water control device. The water control device includes a floating member movably received in the water control tank, and a water control member extended from the floating member in such a manner that when a volume of water in the water control tank is below a predetermined threshold, the water control member is moved to allow water to flow from the water buffering tank to the water control tank. When a volume of water in the water control tank reaches a predetermined threshold, the floating member is driven by water buoyancy to drive the water control member to stop water from flowing to the water control tank from the water buffering housing.

20 Claims, 10 Drawing Sheets

HUMIDIFIER WITH FLOW CONTROL ARRANGEMENT

CROSS REFERENCE TO RELATED APPLICATION

This is a non-provisional application which claims priority to a Chinese patent application having an application number of CN 201910517829.1, and a filing date of Jun. 14, 2019, the entire contents of which is hereby incorporated by reference.

BACKGROUND

Field of Invention

Embodiments of the present disclosure relates to a humidifier, and more particularly to a humidifier comprising a flow control arrangement which is capable of effectively controlling and managing supply of water from a water tank to an atomizer.

Description of Related Arts

A conventional humidifier usually comprises a base having water storage compartment, a water tank detachably mounted on the base, and a water atomizer supported in the base to atomize the water stored in the base mist. The mist will then be delivered to a designated indoor space for increasing a humidity thereof.

A major disadvantage of convention humidifiers such as the one described above is that when the water tank is attached on the base, water stored in the water tank is arranged to be delivered to the water storage compartment of the base for use by the atomizer. Very often, however, too much water is stored in the water storage compartment of the base and this may negatively affect the performance of the atomizer.

As a result, there is a need to develop a humidifier which may effectively control and manage the supply of water from the water tank to the atomizer.

SUMMARY

Implementations of the present disclosure provide a humidifier comprising a flow control arrangement which is capable of effectively controlling and managing supply of water from a water tank to an atomizer.

Implementations of the present disclosure provide a humidifier comprising a flow control arrangement which comprises a floating member arranged to drive a water control member to stop water supply to the atomizer when water stored in a water control tank reaches a predetermined threshold so as to prevent too much water from reaching the atomizer.

In one aspect of embodiments of the present disclosure, it provides a humidifier, comprising:

a base having a water receiving cavity;

a water storage tank having a water storage cavity, and detachably attaching on the base;

an atomizer provided in the base to communicate with a predetermined of amount of water stored in the water receiving cavity; and a flow control arrangement, which comprises:

a water buffering housing mounted on a bottom portion of the water storage tank, the water buffering housing having a water buffering compartment, a water passage inlet communicating the water buffering compartment with the water storage cavity of the water storage tank;

a water control tank mounted on the bottom portion of the water storage tank at a position adjacent to the water buffering housing, the water control tank having a water control compartment, a water control inlet selectively communicating the water control compartment with the water buffering compartment, and a water control outlet selectively communicating the water control compartment with the water receiving cavity of the base; and a water control device, which comprises:

a floating member movably and floatingly provided in the water control compartment of the water control tank; and a water control member extended from the floating member in such a manner that when a volume of water stored in the water control compartment is below a predetermined threshold, the water control member is moved to allow communication between the water control compartment and the water buffering compartment through the water control inlet, wherein when a volume of water stored in the water control compartment reaches a predetermined threshold, the floating member is driven by water buoyancy to drive the water control member to block the water control inlet so as to stop water from flowing to the water control compartment from the water buffering compartment.

This summary presented above is provided merely to introduce certain concepts and not to identify any key or essential features of the claimed subject matter.

DETAILED DESCRIPTION OF THE PREFERRED EMBODIMENT

Figure 1:
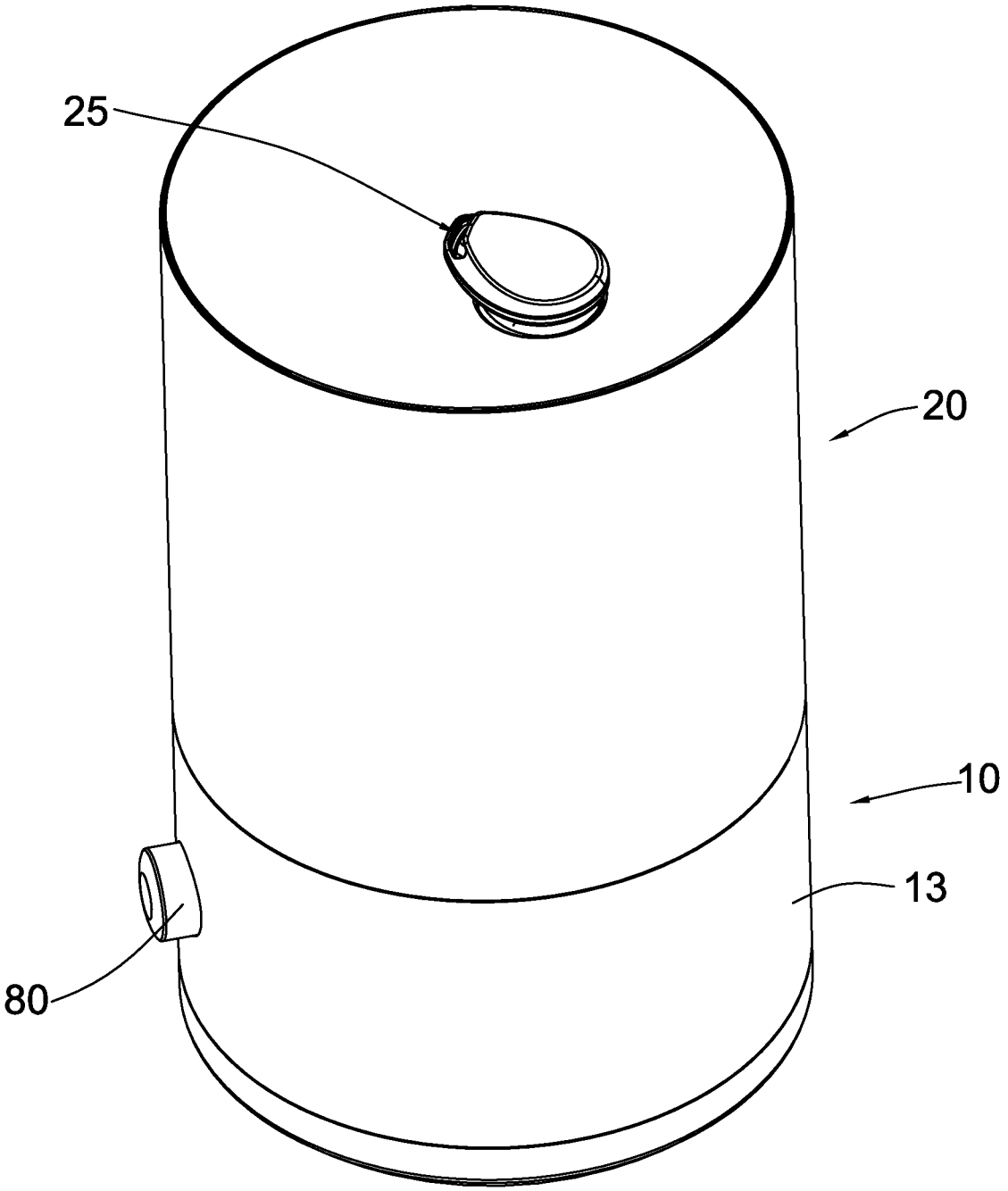
FIG. 1 is a perspective view of a humidifier according to an embodiment of the present disclosure.

The following detailed description of the embodiments is the preferred mode of carrying out the present disclosure. The description is not to be taken in any limiting sense. It is presented for the purpose of illustrating the general principles of embodiments of the present disclosure.

It should be appreciated that the terms "install", "connect", "couple", and "mount" in the following description refer to the connecting relationship in the accompanying drawings for easy understanding of embodiments of the present disclosure. For example, the connection can refer to permanent connection or detachable connection. Furthermore, "connected" may also mean direct connection or indirect connection, or connection through other auxiliary components. Therefore, the above terms should not be an actual connection limitation of the elements of embodiments of the present disclosure.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of embodiments of the present disclosure without limiting the actual location or orientation of embodiments of the present disclosure. Therefore, the above terms should not be an actual location limitation of the elements of embodiments of the present disclosure.

It should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of embodiments of the present disclosure.

Referring to FIG. 1 to FIG. 10 of the drawings, a humidifier according to an embodiment of the present disclosure is illustrated. Broadly, the humidifier may comprise a base 10 having a water receiving cavity 11, a water storage tank 20, an atomizer 30, and a flow control arrangement 40.

The water storage tank 20 may have a water storage cavity 21, and may be detachably attached on the base 10.

The atomizer 30 may be provided in the base 10 to communicate with a predetermined of amount of water stored in the water receiving cavity 11 for atomizing the water stored in the water receiving cavity 11 to form mist.

The flow control arrangement 40 may comprise a water buffering housing 41, a water control tank 42, a water regulating assembly 43, and a water control device 44.

The water buffering housing 41 may be mounted on a bottom portion 22 of the water storage tank 20. The water buffering housing 41 may have a water buffering compartment 411, a water passage inlet 412 communicating the water buffering compartment 411 with the water storage cavity 21 of the water storage tank 20.

The water control tank 42 may be mounted on the bottom portion 22 of the water storage tank 20 at a position adjacent to the water buffering housing 41. The water control tank 42 may have a water control compartment 421, a water control inlet 422 selectively communicating the water control compartment 421 with the water buffering compartment 411, and a water control outlet 423 selectively communicating the water control compartment 421 with the water receiving cavity 11 of the base 10.

The water regulating assembly 43 may be movably provided at the water control outlet 423 of the water control tank 42, in such a manner that when the water storage tank 20 is attached on the base 10, the water regulating assembly 43 may be moved to allow communication between the water control compartment 421 and the water receiving cavity 11 through the water control outlet 423, wherein when the water storage tank 20 is detached from the base 10, the water regulating assembly 43 is moved to block the water control outlet 423.

The water control device 44 may comprise a floating member 441 and a water control member 442. The floating member 441 may be movably and floatingly provided in the water control compartment 421 of the water control tank 42.

The water control member 442 may extend from the floating member 441 in such a manner that when a volume of water stored in the water control compartment 421 is below a predetermined threshold, the water control member 442 may be moved to allow communication between the water control compartment 421 and the water buffering compartment 411 through the water control inlet 422, wherein when a volume of water stored in the water control compartment 421 reaches a predetermined threshold, the floating member 441 is driven by water buoyancy to drive the water control member 442 to block the water control inlet 422 so as to stop water from flowing to the water control compartment 421 from the water buffering compartment 411.

Figure 2:
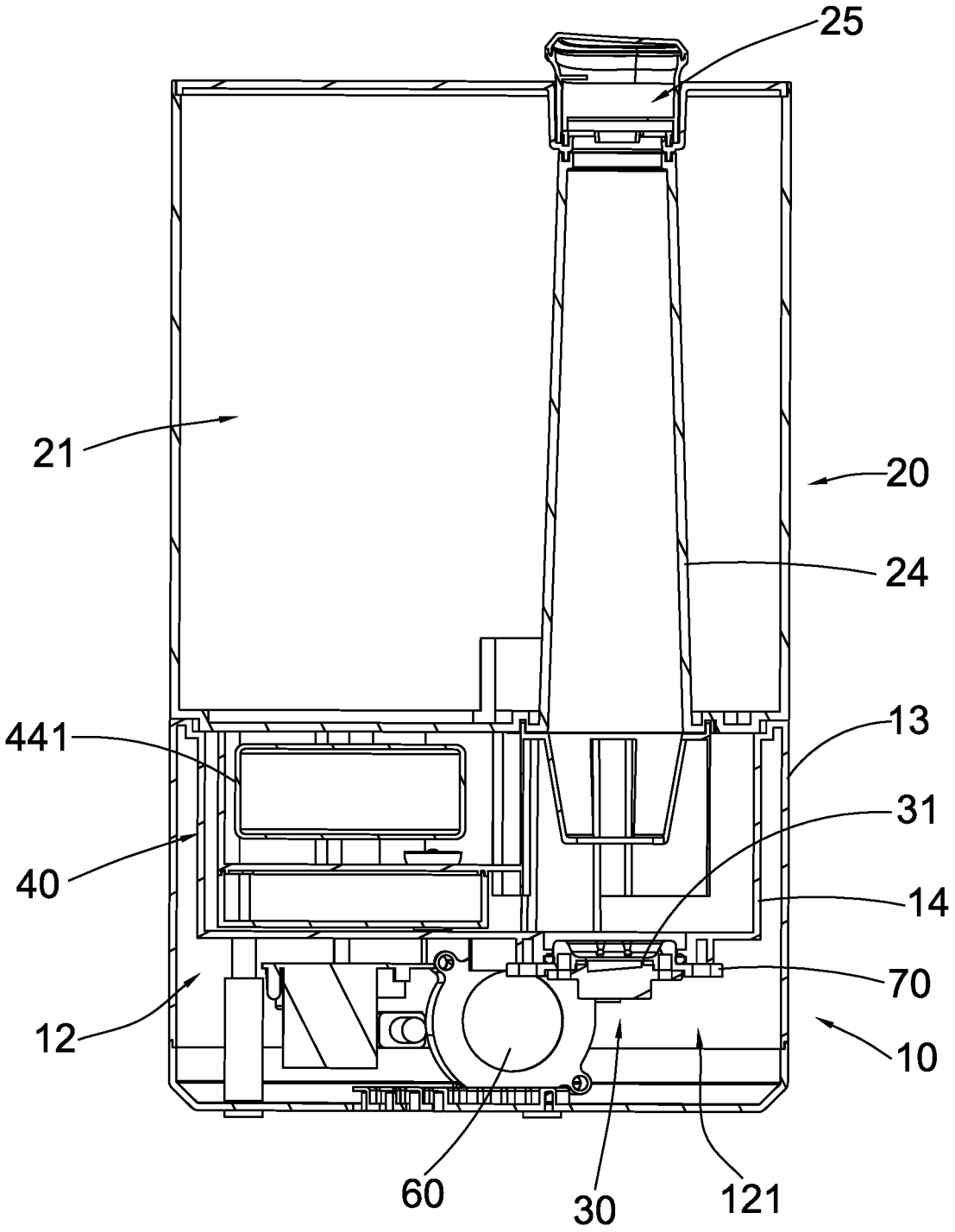
FIG. 2 is a sectional side view of the humidifier according to an embodiment of the present disclosure.
Figure 3:
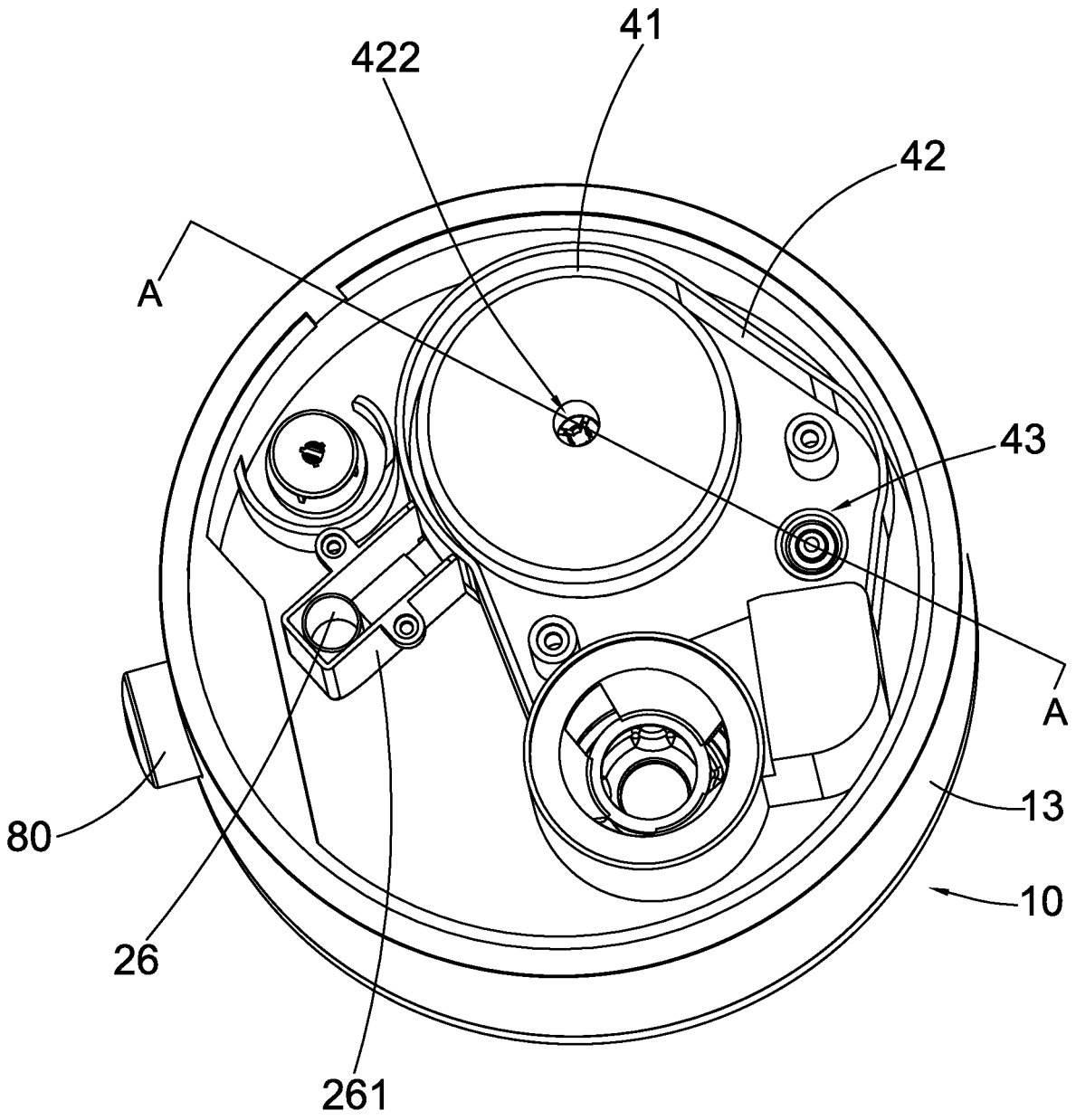
FIG. 3 is schematic diagram of a flow control arrangement of the humidifier according to an embodiment of the present disclosure.
Figure 9:
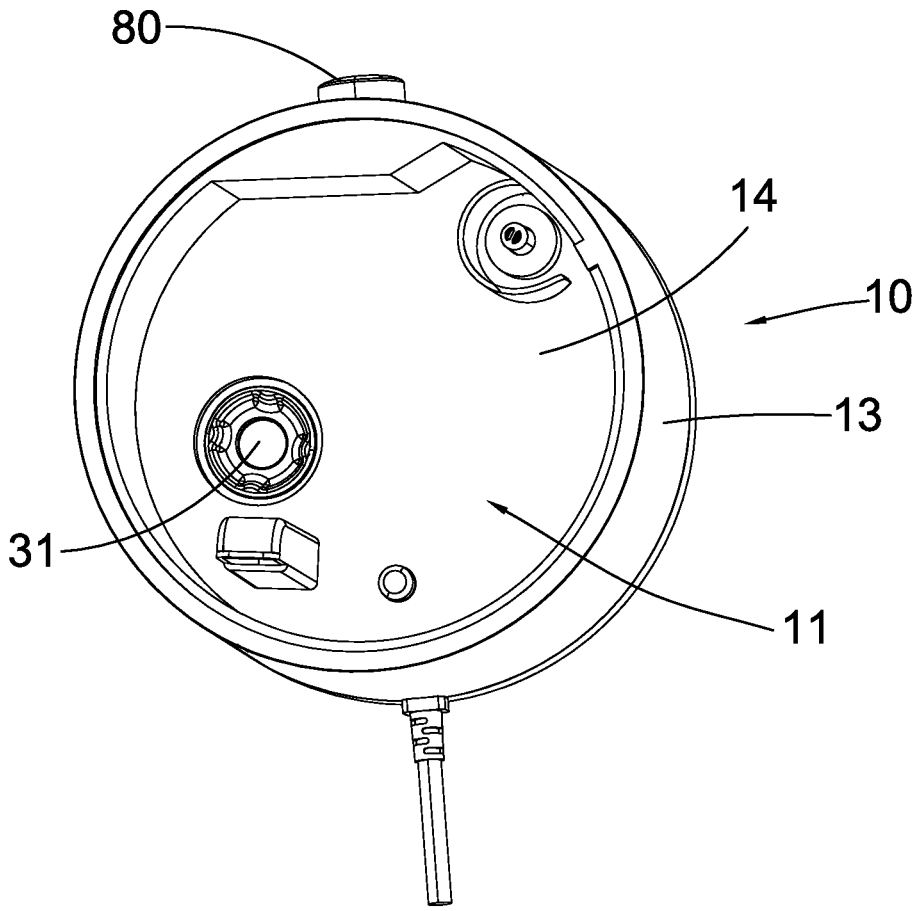
FIG. 9 is a top perspective of a base of the humidifier according to an embodiment of the present disclosure.

According to an embodiment of the present disclosure, the humidifier is for providing mist to a designated indoor space so as to increase humidity thereof. As shown in FIG. 2 and FIG. 9 of the drawings, the base 10 may comprise a base body 13 having an accommodating cavity 12, and a supporting platform 14 mounted in the accommodating cavity 12 to divide the accommodating cavity 12 into a lower securing compartment 121 and the water receiving cavity 11. Most of the electronic components such as a fan 60 and a control Printed Circuit Board (PCB 70) of the present invention may be securely received in the lower securing compartment 121. A control knob 80 may also be provided on the base 10 for allowing a user to control an operation of the present invention.

The water storage tank 20 may be selectively attached on the base body 13 so as to selectively allow a predetermined amount of water to be supplied to the flow control arrangement 40 and the atomizer 30.

The water storage tank 20 may comprise a tank body 23, and mist passage tube 24 provided in the tank body 23. The water storage cavity 21 may be formed in the tank body 23 while the mist passage tube 24 may extend in the water storage cavity 21. The water storage cavity 21 may be arranged to receive a predetermined amount of water while the mist passage tube 24 may allow passage of mist generated from the atomizer 30. Moreover, the water storage tank 20 may further comprise a mist outlet 25 formed as a top opening of the mist passage tube 24 for allowing atomized water (i.e. mist) to be discharged out of the humidifier through the mist outlet 25.

The atomizer 30 may be supported in the base 10 and may comprise an atomizing head 31 exposed to the water receiving cavity 11 of the base 10 for atomizing the water stored therein. In this embodiment, the atomizer 30 may configured as an ultrasonic atomizer and the atomizing head 31 may be configured as having a ceramic diaphragm which may be vibrated at an ultrasonic frequency to create very fine water droplets so as to turn water into mist.

Figure 4:
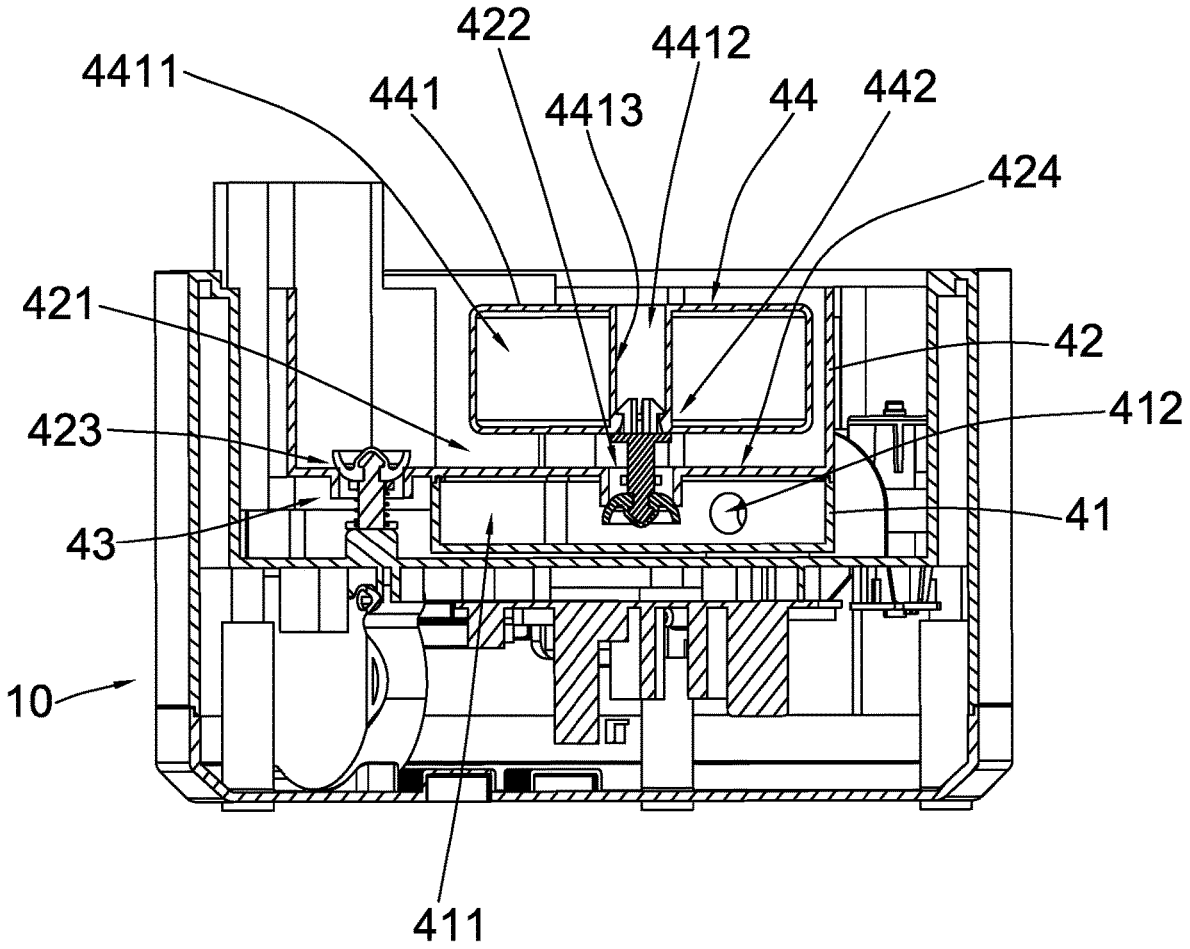
FIG. 4 is a sectional front view of the flow control arrangement and a base of the humidifier according to an embodiment of the present disclosure.
Figure 6:
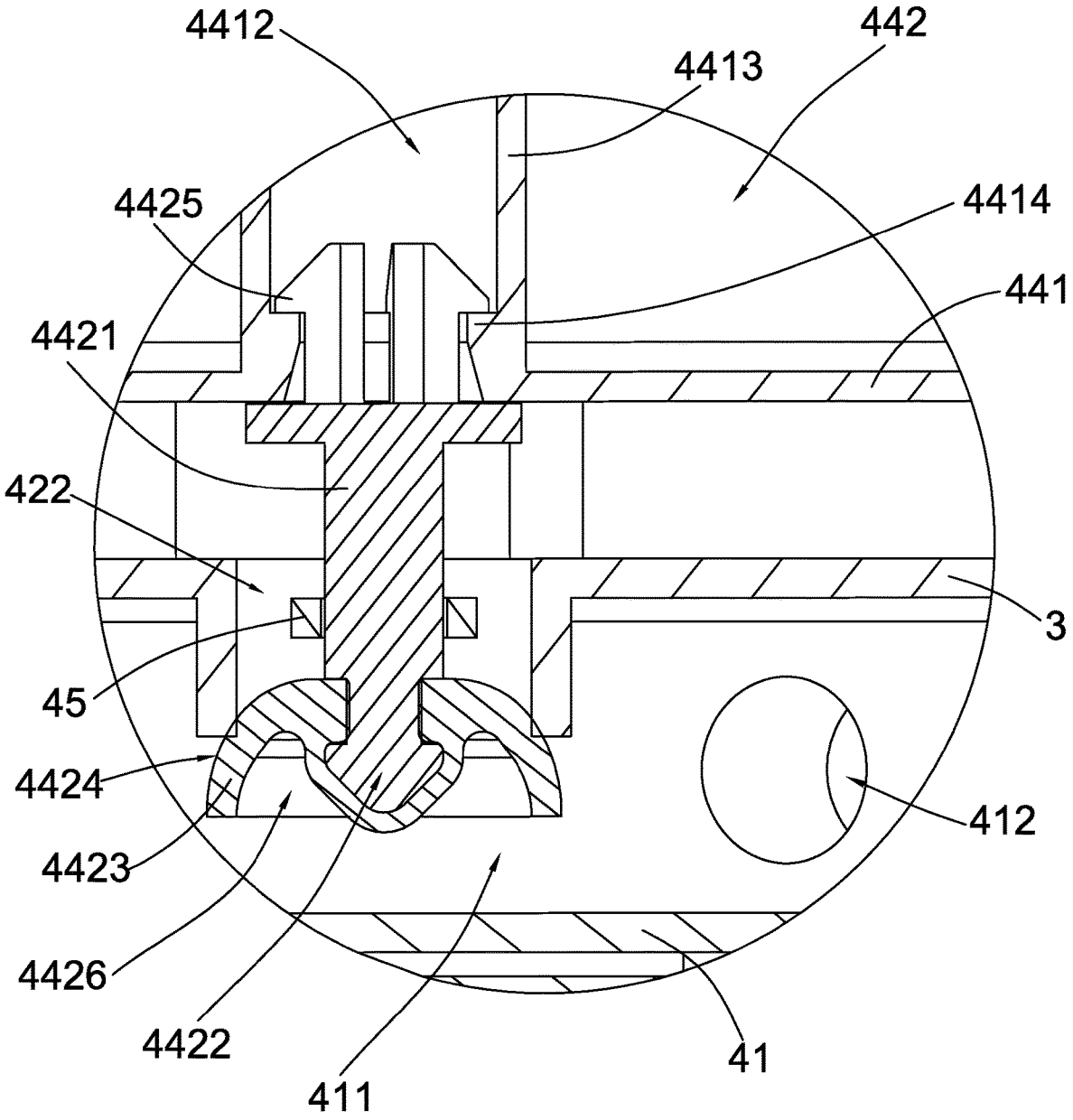
FIG. 6 is a schematic diagram of a water control device of the humidifier according to an embodiment of the present disclosure.

The flow control arrangement 40 may be utilized to control the flow of water from the water storage tank 20 to the water receiving cavity 11 so as to prevent too much water from entering into the water receiving cavity 11. Water stored in the water storage cavity 21 may be guided to flow into the water buffering compartment 411 through the water passage inlet 412. On the other hand, the water buffering compartment 411 may communicate with the water control compartment 421 through the water control inlet 422. When the water has filled the water buffering compartment 411, excessive water may then flow into the water control compartment 421 through the water control inlet 422, subject to the control of the water control member 442. In this embodiment, the water control tank 42 may be positioned above the water buffering compartment 411 so that water level may rise in the water buffering compartment 411 and eventually flow into the water control compartment 421. As shown in FIG. 4 and FIG. 6 of the drawings, water flowing through the water control inlet 422 may be controlled and regulated by the water control device 44.

Figure 7:
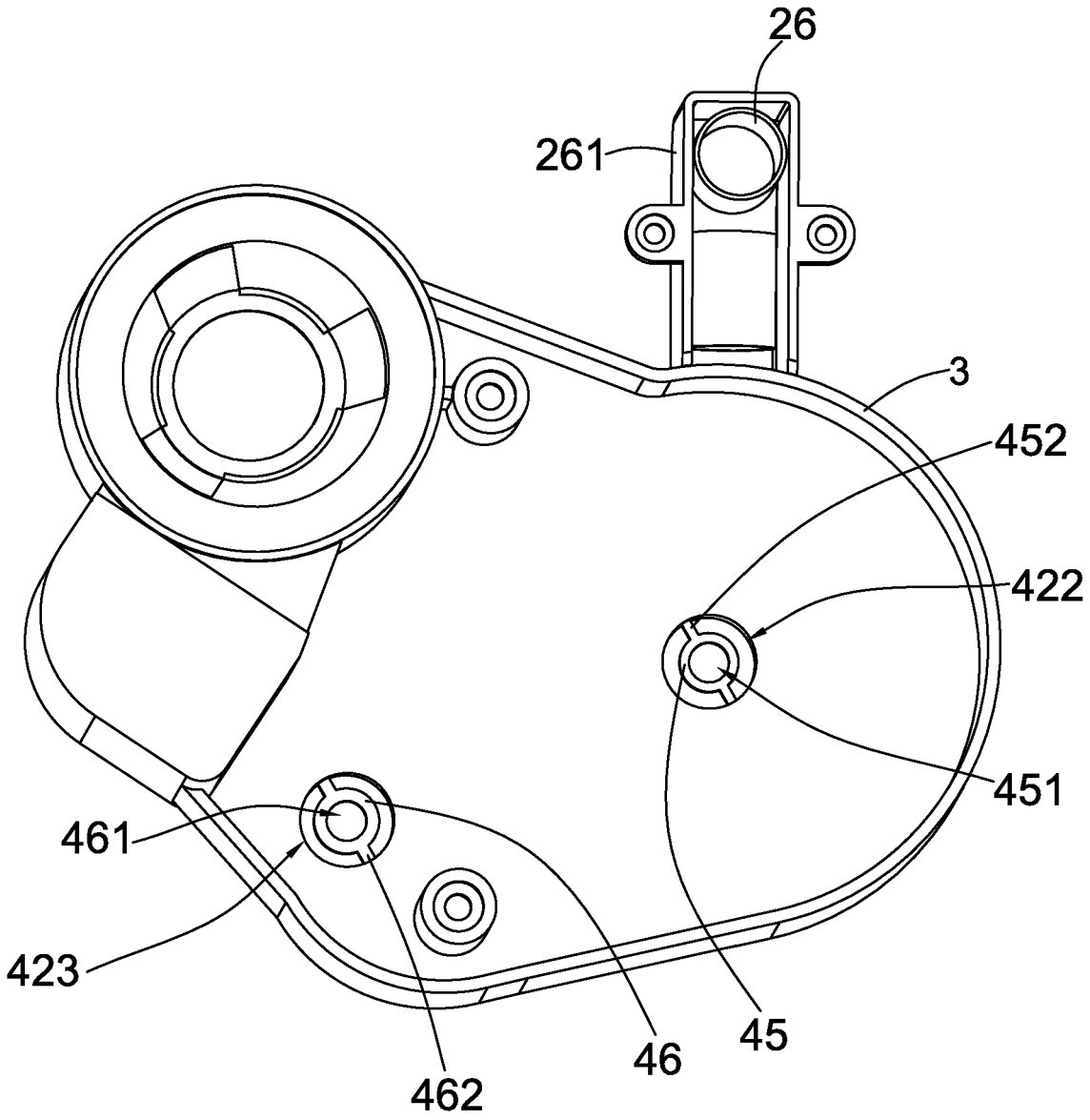
FIG. 7 is a perspective view of a water storage tank of the humidifier according to an embodiment of the present disclosure, illustrating a water passage tube.
Figure 8:
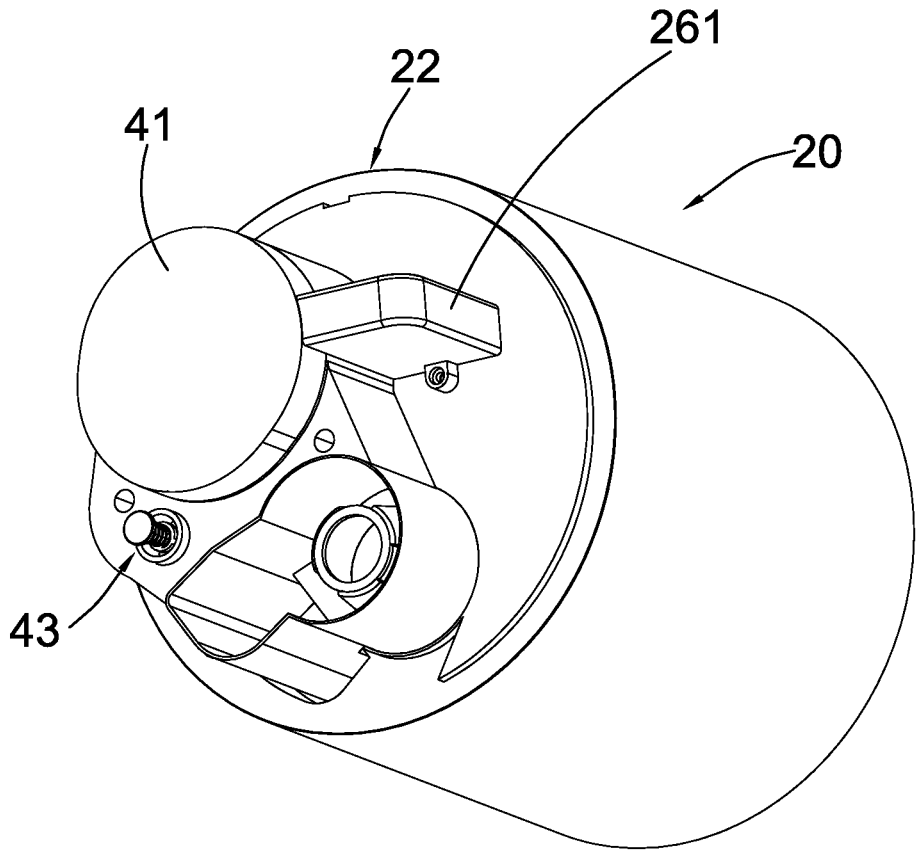
FIG. 8 is a bottom perspective of a water storage tank of the humidifier according to an embodiment of the present disclosure.

Referring to FIG. 7 of the drawings, the water storage tank 20 may further comprise a water passage tube 26 extended between the water buffering compartment 411 and the water storage cavity 21 for providing a path for allowing water to flow from the water storage cavity 21 to the water buffering compartment 411. The water passage tube 26 may be protected by a protective housing 261.

The water control device 44 may movably receive in the water control tank 42 to selectively allow or block water passage flowing through the water control inlet 422. Specifically, the floating member 441 may have a sealed hollow structure which may be filled with air. Thus, when the floating member 441 is immerse in water, the floating member 441 may tend to move upwardly and float on water. On the other hand, the water control member 442 may extend downwardly from the floating member 441 and movably pass through the water control inlet 422. In this embodiment, the floating member 441 may have a cylindrical structure as shown in FIG. 10 of the drawings.

Figure 10:
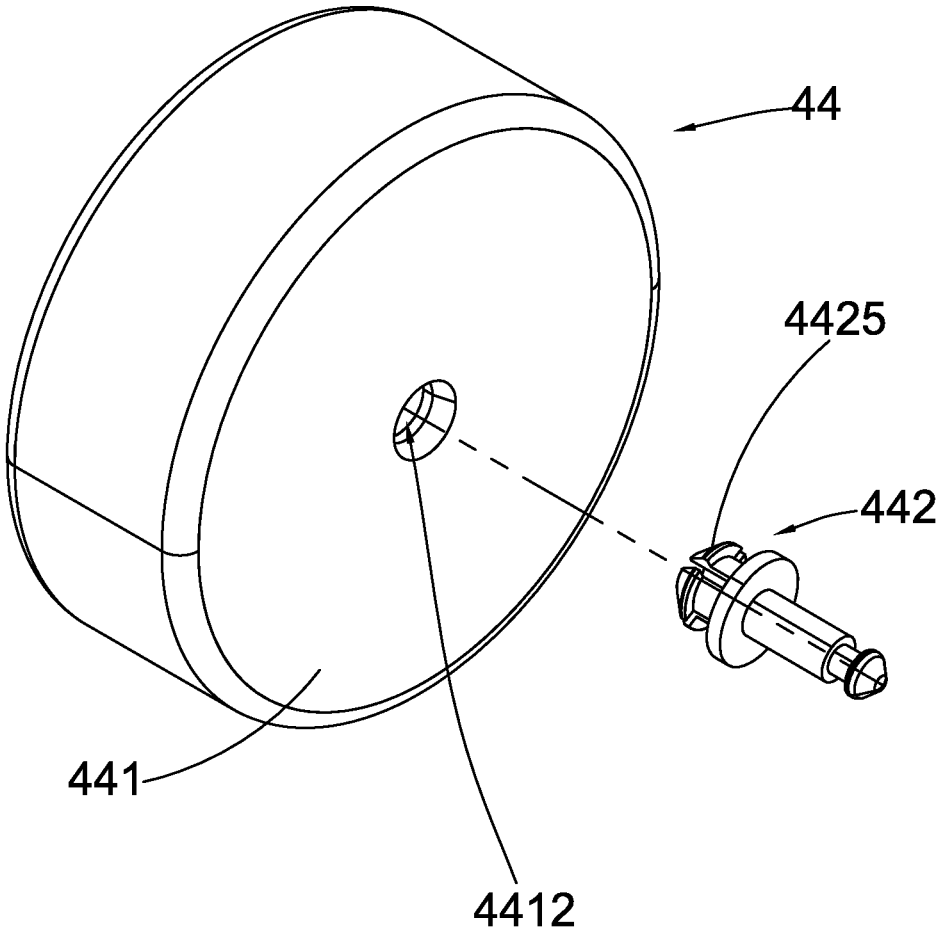
FIG. 10 is a schematic perspective view of a water control device of the humidifier according to an embodiment of the present disclosure.

Referring to FIG. 4, FIG. 6 and FIG. 10 of the drawings, the floating member 441 may have at least one air chamber 4411, and a through mounting slot 4412 extended along a vertical axis of the floating member 441, wherein the mounting slot 4412 may be surrounded by a surrounding sidewall 4413. The air chamber 4411 may be sealed and filled with air so that it may float on water. The mounting slot 4412 may be formed outside the air chamber 4411. The floating member 441 may further comprise a mounting latch 4414 extended from the surrounding sidewall 4413 toward the through mounting slot 4412.

The water control member 442 may comprise a connecting stem 4421 extended from the floating member 441, and an enlarged blocking head 4423 provided at a lower free portion 4422 of the connecting stem 4421. Each of the water control inlet 422, the connecting stem 4421 and the enlarged blocking head 4423 may have a circular cross section when viewed from the top. Accordingly, as shown in FIG. 6 of the drawing, a diameter of the connecting stem 4421 is smaller than a diameter of the water control inlet 422 while the enlarged blocking head 4423 may have a diameter substantially larger than that of the connecting stem 4421 and the water control inlet 422. Moreover, the enlarged blocking head 4423 may be configured to form a semi-spherical structure having a curved external surface 4424. More specifically, the enlarged blocking head 4423 may have a first mounting cavity 4426 wherein the lower end portion 4422 may be securely received and mounted in the mounting cavity 4426 for securely connecting the connecting stem 4421 with the enlarged blocking head 4423. The enlarged blocking head 4423 may be configured from soft and deformable material such as rubber so as to effectively block water from passing through the water control inlet 422.

On the other hand, the water control member 442 may further comprise a plurality of connectors 4425 extended from the connecting stem 4421, wherein the connectors 4425 may be arranged to detachably connect to the mounting latch 4414 so as to detachably connect the water control member 442 to the floating member 441. Note that the connectors 4425 may be configured from soft and deformable material such as rubber so as to facilitate easy connection and detachment between the water control member 442 and the floating member 441. Alternatively, the water control member 442 and the floating member 441 may also be connected by other mechanisms or form an integral one-piece structure without the connectors 4425.

The flow control arrangement 40 may further comprise a first securing ring 45 mounted in the water control inlet 422 wherein the connecting stem 4421 may pass through a first central cavity 451 of the first securing ring 45 in a longitudinally movable manner. Thus, the first securing ring 45 may serve to guide and limit a movement of the connecting stem 4421 so that the connecting stem 4421 may only move in a longitudinal direction thereof. The first securing ring 45 may be mounted to the water buffering housing 41 through a plurality of first extension members 452.

When the water buffering compartment and the water control compartment 421 are empty, an inherent weight of the water control device 44 may cause the floating member 441 to rest on a bottom surface 424 of the water control compartment 421 while the water control member 422 is moved such that the enlarged blocking head 4423 does not block the water control inlet 422.

When water from the water storage cavity 21 flows into the water buffering compartment 411, water may eventually fill up the water buffering compartment 411 and enter the water control compartment 421 through the unblocked water control inlet 422. When more and more water fills up the water control compartment 421, the floating member 441 may be driven by water buoyancy to move upwardly in the water control compartment 421. At the same time, this may drive the water control member 442 to move upwardly along the water control inlet 422. When water keeps flowing into the water control compartment 421, the water control member 442 continues moving upwardly along the water control inlet 422 until the enlarged blocking head 4423 hits a side boundary wall 425 of the water control inlet 422. This movement may block the water control inlet 42 so as to stop water from further passing through the water control inlet 422. In other words, when water in the water control compartment 421 reaches a predetermined threshold, the water control device 44 is moved so as to block the water control inlet 422 for blocking water from further entering the water control compartment from the water buffering compartment 411 through the water control inlet 422.

In this embodiment, the water control tank 42 may be positioned above the water buffering housing 41. The water control tank 42 and the water buffering housing 41 may communicate with each other through the water control inlet 422 as regulated by the water control device 44. When water fills up the water control compartment 421, the floating member 441 may move upwardly in the water control compartment until the water control member 442 is blocked by the side boundary wall 425 of the water control inlet 422.

Figure 5:
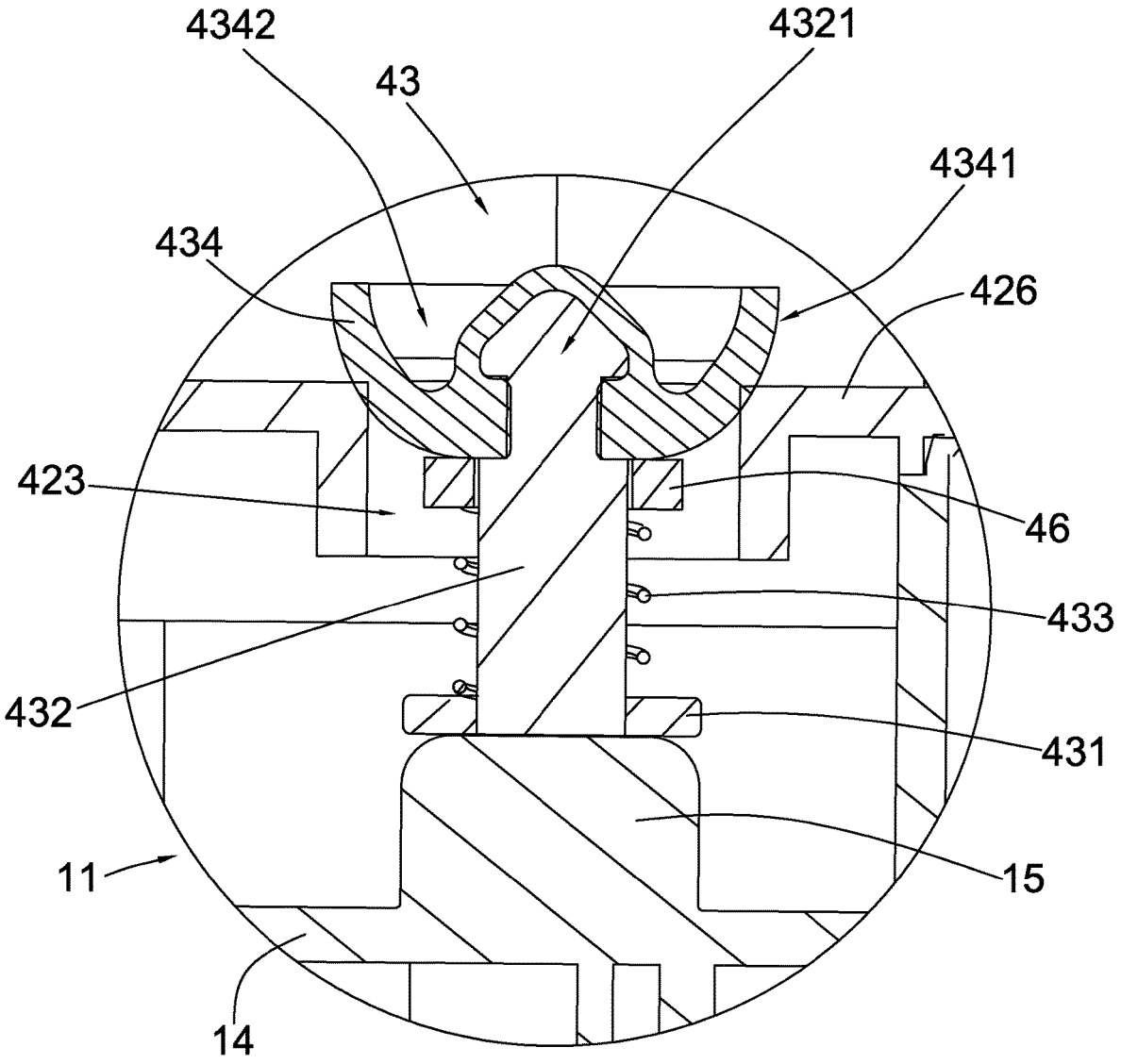
FIG. 5 is a schematic diagram of a water regulating assembly of the humidifier according to an embodiment of the present disclosure.

The water stored in the water control tank 42 may exit the water control compartment 421 through the water control outlet 423 as regulated by the water regulating assembly 43. As shown in FIG. 4 and FIG. 5 of the drawings, the water regulating assembly 43 may comprise a supporting member 431, a sealing member 434 movably provided at the water control outlet 423, a regulating stem 432 extended between the supporting member 431 and the sealing member 434, and a resilient member 433 coupled with the regulating stem 432 for exerting an extension force toward the supporting member 431.

On the other hand, the base 10 may comprise a protruding body 15 extended from the supporting platform 14 at a position corresponding to the supporting member 431 of the water regulating assembly 43. When the water storage tank 20 is detached from the base 10, the resilient member 433 may exert an urging force toward the supporting member 431 for downwardly pulling the sealing member 434 to bias against a peripheral wall 426 of the water control outlet 423 so as to block the water control outlet 423 for preventing water from the water control compartment 421 to flow into the water receiving cavity 11 of the base 10.

The flow control arrangement 40 may further comprise a second securing ring 46 mounted in the water control outlet 423 wherein the regulating stem 432 may pass through a second central cavity 461 of the second securing ring 46 in a longitudinally movable manner. Thus, the second securing ring 46 may serve to guide and limit a movement of the regulating stem 432 so that the regulating stem 432 may only move in a longitudinal direction thereof. The second securing ring 46 may be mounted on the water control tank 42 through a plurality of first extension members 462. Moreover, the resilient member 433 may be mounted between the second securing ring 46 and the supporting member 431 for exerting a downward urging force toward the supporting member 431, as shown in FIG. 5 of the drawings.

When the water storage tank 20 is attached on the base 10, the protruding body 15 may be arranged to bias against the supporting member 431 so as to compress the resilient member 433 for upwardly pushing the sealing member 434 to unblock the water control outlet 423. When the sealing member 434 is pushed upwardly to unblock the water control outlet 423, water from the water control compartment 421 may be allowed to flow into the water receiving cavity 11 of the base 10 for being atomized by the atomizer 30.

Each of the regulating stem 432, the water control outlet 423 and the sealing member 434 may have a circular cross section when view from the top, wherein a diameter of the regulating stem 432 may be smaller than that of the water control outlet 423 while the sealing member 434 may have a diameter substantially larger than that of the regulating stem 432 and the water control outlet 423. When the sealing member 434 biases against the peripheral wall 426 of the water control outlet 423, water is prevented from passing through the water control outlet 423. Note that the sealing member 434 may have a semi-spherical structure which may have a curved external surface 4341. The sealing member 434 may be configured by waterproof materials such as rubber material, plastic material or even foam material.

Moreover, the sealing member 434 may be configured to form a semi-spherical structure having a curved external surface 4341. The sealing member 434 may have a second mounting cavity 4342 wherein an upper end portion 4321 of the regulating stem 432 may be securely mounted in the second mounting cavity 4342 for securely connecting the regulating stem 432 with the sealing member 434. The sealing member 434 may be configured from soft and deformable material such as rubber so as to effectively block water from passing through the water control outlet 423.

It is worth mentioning that the water control tank 42 and the water buffering housing 41 as disclosed above may be separate pieces of components in which the water buffering housing 41 may be provided underneath the water control tank 42. Alternatively, the water control tank 42 and the water buffering housing 41 may form an integral structure (i.e. a one-piece body) during manufacturing.

Embodiments of the present disclosure, while illustrated and described in terms of disclosed embodiments and several alternatives, is not limited to the particular description contained in this specification. Additional alternative or equivalent components could also be used to practice embodiments of the present disclosure.

What is claimed is:

1. A humidifier, comprising:

a base having a water receiving cavity;

a water storage tank having a water storage cavity, and detachably attaching on said base;

an atomizer provided in said base to communicate with a predetermined amount of water stored in said water receiving cavity; and a flow control arrangement, which comprises:

a water buffering housing mounted on a bottom portion of said water storage tank, said water buffering housing having a water buffering compartment, a water passage inlet communicating said water buffering compartment with said water storage cavity of said water storage tank;

a water control tank mounted on said bottom portion of said water storage tank at a position adjacent to said water buffering housing, said water control tank having a water control compartment, a water control inlet selectively communicating said water control compartment with said water buffering compartment, and a water control outlet selectively communicating said water control compartment with said water receiving cavity of said base; and a water control device, which comprises:

a floating member movably and floatingly provided in said water control compartment of said water control tank; and a water control member extended from said floating member in such a manner that when a volume of water stored in said water control compartment is below a predetermined threshold, said water control member is moved to allow communication between said water control compartment and said water buffering compartment through said water control inlet, wherein when a volume of water stored in said water control compartment reaches a predetermined threshold, said floating member is driven by water buoyancy to drive said water control member to block said water control inlet so as to stop water from flowing to said water control compartment from said water buffering compartment.

2. The humidifier, as recited in claim 1, wherein said floating member has a sealed hollow structure having at least one air chamber formed therein, said air chamber being arranged to fill with air so that when said floating member is immersed in water, said floating member is arranged to move upwardly and float on water.

3. The humidifier, as recited in claim 2, wherein said water control member comprises a connecting stem extended from said floating member, and an enlarged blocking head provided at a lower free portion of said connecting stem, each of said water control inlet, said connecting stem and said enlarged blocking head having a circular cross section when viewed from a top, a diameter of said connecting stem being smaller than a diameter of said water control inlet while said enlarged blocking head having a diameter substantially larger than that of said connecting stem and said water control inlet.

4. The humidifier, as recited in claim 3, wherein said enlarged blocking head has a semi-spherical structure having a curved external surface, said enlarged blocking head further having a first mounting cavity wherein a lower end portion of said connecting stem is securely mounted in said mounting cavity for securely connecting said connecting stem to said enlarged blocking head.

5. The humidifier, as recited in claim 4, wherein said floating member further has a through mounting slot extended along a vertical axis of said floating member, and surrounded by a surrounding sidewall, said mounting slot being formed outside said air chamber, said floating member further comprising a mounting latch extended from said surrounding sidewall, said water control member further comprising a plurality of connectors extended from said connecting stem, wherein said connectors are arranged to detachably connect to said mounting latch so as to detachably connect said water control member to said floating member.

6. The humidifier, as recited in claim 5, wherein said flow control arrangement further comprises a first securing ring having a first central cavity mounted in said water control inlet, said connecting stem being arranged to pass through said first central cavity in a longitudinally movable manner for guiding and limiting a movement of said connecting stem.

7. The humidifier, as recited in claim 6, further comprising a water regulating assembly movably provided at said water control outlet of said water control tank, in such a manner that when said water storage tank is attached on said base, said water regulating assembly is moved to allow communication between said water control compartment and said water receiving cavity through said water control outlet, wherein when said water storage tank is detached from said base, said water regulating assembly is moved to block said water control outlet.

8. The humidifier, as recited in claim 7, wherein said water regulating assembly comprises a supporting member, a sealing member movably provided at said water control outlet, a regulating stem extended between said supporting member and said sealing member, and a resilient member coupled with said regulating stem for exerting an urging force toward said supporting member, said resilient member being mounted between said second securing ring and said supporting member, said base comprising a protruding body positioned corresponding to said supporting member of said water regulating assembly.

9. The humidifier, as recited in claim 8, wherein said flow control arrangement further comprises a second securing ring having second central cavity mounted in said water control outlet, wherein said regulating stem is arranged to pass through said second central cavity in a longitudinally movable manner for guiding and limiting a movement of said regulating stem.

10. The humidifier, as recited in claim 9, wherein each of said regulating stem, said water control outlet and said sealing member has a circular cross section when view from a top, a diameter of said regulating stem being smaller than that of said water control outlet while a diameter of said sealing member being substantially larger than that of said regulating stem and said water control outlet.

11. The humidifier, as recited in claim 10, wherein said sealing member has a semi-spherical structure having a curved external surface and a second mounting cavity, wherein an upper end portion of said regulating stem is securely mounted in said second mounting cavity for securely connecting said regulating stem to said sealing member.

12. The humidifier, as recited in claim 11, wherein said water storage tank further comprises a water passage tube extended between said water buffering compartment and said water storage cavity for providing a path for allowing water to flow from said water storage cavity to said water buffering compartment.

13. The humidifier, as recited in claim 3, further comprising a water regulating assembly movably provided at said water control outlet of said water control tank, in such a manner that when said water storage tank is attached on said base, said water regulating assembly is moved to allow communication between said water control compartment and said water receiving cavity through said water control outlet, wherein when said water storage tank is detached from said base, said water regulating assembly is moved to block said water control outlet.

14. The humidifier, as recited in claim 13, wherein said water regulating assembly comprises a supporting member, a sealing member movably provided at said water control outlet, a regulating stem extended between said supporting member and said sealing member, and a resilient member coupled with said regulating stem for exerting an urging force toward said supporting member, said resilient member being mounted between said second securing ring and said supporting member, said base comprising a protruding body positioned corresponding to said supporting member of said water regulating assembly.

15. The humidifier, as recited in claim 1, further comprising a water regulating assembly movably provided at said water control outlet of said water control tank, in such a manner that when said water storage tank is attached on said base, said water regulating assembly is moved to allow communication between said water control compartment and said water receiving cavity through said water control outlet, wherein when said water storage tank is detached from said base, said water regulating assembly is moved to block said water control outlet.

16. The humidifier, as recited in claim 15, wherein said water regulating assembly comprises a supporting member, a sealing member movably provided at said water control outlet, a regulating stem extended between said supporting member and said sealing member, and a resilient member coupled with said regulating stem for exerting an urging force toward said supporting member, said resilient member being mounted between said second securing ring and said supporting member, said base comprising a protruding body positioned corresponding to said supporting member of said water regulating assembly.

17. The humidifier, as recited in claim 16, wherein said flow control arrangement further comprises a second securing ring having second central cavity mounted in said water control outlet, wherein said regulating stem is arranged to pass through said second central cavity in a longitudinally movable manner for guiding and limiting a movement of said regulating stem.

18. The humidifier, as recited in claim 17, wherein each of said regulating stem, said water control outlet and said sealing member has a circular cross section when view from a top, a diameter of said regulating stem being smaller than that of said water control outlet while a diameter of said sealing member being substantially larger than that of said regulating stem and said water control outlet.

19. The humidifier, as recited in claim 18, wherein said sealing member has a semi-spherical structure having a curved external surface and a second mounting cavity, wherein an upper end portion of said regulating stem is securely mounted in said second mounting cavity for securely connecting said regulating stem to said sealing member.

20. The humidifier, as recited in claim 19, wherein said water storage tank further comprises a water passage tube extended between said water buffering compartment and said water storage cavity for providing a path for allowing water to flow from said water storage cavity to said water buffering compartment.

* * * * *